US011046915B2

(12) United States Patent
Piorkowski et al.

(10) Patent No.: US 11,046,915 B2
(45) Date of Patent: Jun. 29, 2021

(54) USE OF POLYGLYCOLS TO CONTROL RHEOLOGY OF UNIT DOSE DETERGENT COMPOSITIONS

(71) Applicant: Henkel IP & Holding GmbH, Duesseldorf (DE)

(72) Inventors: Daniel T Piorkowski, Fairfield, CT (US); David S Stott, II, McKinney, TX (US)

(73) Assignee: Henkel IP & Holding GmbH, Duesseldorf (DE)

( * ) Notice: Subject to any disclaimer, the term of this patent is extended or adjusted under 35 U.S.C. 154(b) by 85 days.

(21) Appl. No.: 16/231,269

(22) Filed: Dec. 21, 2018

(65) Prior Publication Data

US 2020/0199491 A1 Jun. 25, 2020

(51) Int. Cl.

| | |
|---|---|
| ***C11D 1/22*** | (2006.01) |
| ***C11D 1/29*** | (2006.01) |
| ***C11D 1/72*** | (2006.01) |
| ***C11D 1/83*** | (2006.01) |
| ***C11D 3/20*** | (2006.01) |

(Continued)

(52) U.S. Cl.

CPC ..... *C11D 1/83* (2013.01); *C11D 3/2044* (2013.01); *C11D 3/2065* (2013.01); *C11D 3/3707* (2013.01); *C11D 17/043* (2013.01); *C11D 1/22* (2013.01); *C11D 1/75* (2013.01)

(58) Field of Classification Search

CPC .... C11D 1/22; C11D 1/29; C11D 1/72; C11D 1/83; C11D 3/2041; C11D 3/2065; C11D 3/3707; C11D 17/043

See application file for complete search history.

(56) References Cited

U.S. PATENT DOCUMENTS

| | | | |
|---|---|---|---|
| 3,812,041 | A | 5/1974 | Inamorato |
| 4,744,916 | A | 5/1988 | Adams |

(Continued)

FOREIGN PATENT DOCUMENTS

| | | | |
|---|---|---|---|
| CA | 1293905 | C | 1/1992 |
| GB | 2209342 | A | 5/1989 |

(Continued)

OTHER PUBLICATIONS

PCT International Search Report PCT/US2019/067997 Completed: Apr. 23, 2020 dated Apr. 24, 2020 10 Pages.

(Continued)

*Primary Examiner* — Brian P Mruk

(74) *Attorney, Agent, or Firm* — Bojuan Deng

(57) ABSTRACT

A method for maintaining a consistent, low viscosity profile of a unit dose detergent composition for enhanced hydration and dissolution upon hydration including the steps of: (1) A method for maintaining a consistent, low viscosity profile of a unit dose detergent composition for enhanced hydration and dissolution upon hydration including the steps of: (1) providing the detergent composition including: about 2.5 to about 15 wt. % of a polyglycol, an alkyl-ether sulfate, a linear alkylbenzene sulfonate, and a fatty alcohol ethoxylate, wherein the alkyl-ether sulfate, linear alkylbenzene sulfonate, and fatty alcohol ethoxylate are collectively present in an amount of 30 to 70 wt. %, by weight of the detergent composition; and (2) encapsulating the detergent composition in a pouch made of a water soluble film.

15 Claims, 2 Drawing Sheets

(51) Int. Cl.

| | |
|---|---|
| ***C11D 3/37*** | (2006.01) |
| ***C11D 17/04*** | (2006.01) |
| *C11D 1/75* | (2006.01) |

(56) References Cited

U.S. PATENT DOCUMENTS

| | | | | |
|---|---|---|---|---|
| 6,083,897 | A | 7/2000 | Lewis et al. | |
| 6,482,792 | B2 | 11/2002 | Ip | |
| 6,566,317 | B2 | 5/2003 | Morris et al. | |
| 2004/0077519 | A1 | 4/2004 | Price et al. | |
| 2006/0094617 | A1 | 5/2006 | Price et al. | |
| 2011/0319311 | A1* | 12/2011 | Labeque | C11D 10/04 510/296 |
| 2012/0175797 | A1 | 7/2012 | Labeque et al. | |
| 2017/0321152 | A1 | 11/2017 | Meine et al. | |
| 2018/0216038 | A1 | 8/2018 | Mort, III et al. | |
| 2018/0216052 | A1 | 8/2018 | Denome et al. | |

FOREIGN PATENT DOCUMENTS

| | | | | |
|---|---|---|---|---|
| WO | 2017040558 | A1 | 3/2017 | |
| WO | WO 2017/156141 | * | 9/2017 | C11D 3/20 |

OTHER PUBLICATIONS

BIO-SOFT® S-101, CAS Registry No. 68584-22-5; Stepan Company. Northfield, IL, Oct. 2017 Supersedes; Jan. 2012.

* cited by examiner

USE OF POLYGLYCOLS TO CONTROL RHEOLOGY OF UNIT DOSE DETERGENT COMPOSITIONS

FIELD OF THE INVENTION

The field of this invention relates to unit dose detergent compositions. Specifically, this invention relates to the inclusion of a polyglycol which facilitates dilution of the unit dose detergent compositions.

BACKGROUND OF THE INVENTION

Unit dose detergent compositions have seen increasing adoption by consumers over the past few years. Unit dose detergent compositions include a liquid and/or solid detergent composition which is enclosed in a pouch made of a water soluble polymer film. When the unit dose is placed in a washing machine, the film dissolves, releasing the detergent composition dose into the wash. The detergent composition is then available to perform the desired cleaning and/or other functions. Unit dose detergent compositions avoid the need to measure a specific amount of detergent composition into a wash. Unit dose detergent compositions also avoid spills and similar transfer of detergent compositions to the surroundings.

As noted above, unit dose detergent compositions have been supplied with powder (solid) and liquid detergent compositions. However, solid detergent compositions must dissolve before the detergent composition becomes available to function in the wash. As the initial opening in the water soluble film may be small, powder detergent compositions may clump and/or otherwise be slowed in dissolving into the wash compared to a broadly distributed powder with more surface area exposed to the water. This reduced dissolution rate may reduce the effectiveness of such powder based unit-dose products. For example, the solid detergent composition may only be available in the wash for a part of the desired exposure time, reducing the effectiveness of the detergent composition in cleaning.

With liquid detergent compositions in unit dose formulations, this problem might appear to be avoided as there is no solid phase to slow the ingress of water. However, many liquid detergent compositions in unit dose include surfactants, such as sodium laureth sulfate. Such liquid detergent compositions can also be difficult to dissolve. For example, such detergent compositions, upon dilution with water, may have viscosities, at one point, approach 400 Pa·S when measured at a shear rate of 0.42 l/sec using commonly available rheometers. As a result, the surfactants may not homogeneously and promptly disperse in water when in use and their cleaning effectiveness is compromised. Accordingly, there remains an opportunity for improvement. It is preferred that detergent compositions maintains a consistent, low viscosity profile to enhance hydration and dissolution profile. Furthermore, other desirable features and characteristics of the present disclosure will become apparent from the subsequent detailed description of the disclosure and the appended claims, taken in conjunction this background of the disclosure.

BRIEF SUMMARY OF THE INVENTION

Among other embodiments, this specification describes a process for maintaining a consistent, low viscosity profile of a unit dose detergent composition to enhance its hydration and dissolution, which includes the steps of: providing the detergent composition including: about 2.5 to about 15 wt. % of a polyglycol, an alkyl-ether sulfate, a linear alkylbenzene sulfonate, and a fatty alcohol ethoxylate, wherein the alkyl-ether sulfate, linear alkylbenzene sulfonate, and fatty alcohol ethoxylate are collectively present in an amount of 30 to 70 wt. %, by weight of the detergent composition.

The polyglycol may be present in an amount from about 2.5 to about 15 wt. %, preferably, from about 4 to about 10 wt. %, by weight of the detergent composition, and more preferably, from about 6 to about 8 wt. %, by weight of the detergent composition. In some embodiments, the polyglycol is about 5 wt. %; in other embodiments, the polyglycol is about 7.5 wt. %, by weight of the detergent composition.

In an embodiment, the polyglycol may be a polyethylene glycol homopolymer (PEG). The polyglycol may be a polypropylene glycol homopolymer (PPG). The polyglycol may be a copolymer which includes PEG and/or PPG repeat units along with other glycol repeat units. The repeat units may have pendant hydrocarbon substitutions, for example, a methyl group.

In an embodiment, the polyglycol has a molecular weight between 200 and 1200 Daltons, preferably, 300 to 800 Daltons, and most preferably from 300 to 500 Daltons. The polyglycol may be a linear polyglycol. The polyglycol may be a star, comb, and/or network polyglycol.

In an embodiment, the detergent composition further includes: 20 to 30 wt. % of a C2 to C5 polyol and 2 to 8 wt. % of a C2 to C5 alkanolamine, and wherein the alkyl-ether sulfate, the linear alkyl benzene sulfonate, and the fatty alcohol ethoxylate are present in a weight ratio of (2 to 5):1:(3 to 10) in the detergent composition. For example, the alkyl-ether sulfate may have a C12 alkyl chain.

In some embodiments, the C2 to C5 polyol is a mixture of glycerine and propylene glycol, and wherein a ratio of glycerine to propylene glycol in the unit dose detergent compositions is within 2:1 to 1:2.

This specification also describes a unit dose detergent composition with Newtonian or close to Newtonian behavior during hydration, including: 30 to 70 wt. % of a mixture being: an alkyl-ether sulfate, a linear alkylbenzene sulfonate, and a fatty alcohol ethoxylate; and 2.5 to 15 wt. % of a polyglycol. The detergent composition may be used in a unit dose pack detergent product.

Preferably, the polyglycol is from about 4 to about 10 wt. %, by weight of the detergent composition, and more preferably, from about 6 to about 8 wt. %, by weight of the detergent composition. In some embodiments, the polyglycol is about 5 wt. %; in other embodiments, the polyglycol is about 7.5 wt. %, by weight of the detergent composition.

In some embodiments, the alkyl-ether sulfate, the linear alkyl benzene sulfonate, and the fatty alcohol ethoxylate are present in a weight ratio of (2 to 5):1: (3 to 10) in the composition. In some embodiments, the composition includes less than 20 wt. % water.

This specification also describes a unit dose detergent product, including: a pouch made of a water soluble film, a detergent composition which is enclosed in the pouch, wherein the detergent composition includes: a polyglycol in an amount about 2.5 to about 15 wt. %, by weight of the detergent composition; alkyl-ether sulfates, wherein the alkyl-ether sulfates comprise from about 12 to about 50 wt. %, by weight of the detergent composition; and water, wherein a mixture of 2 parts of the detergent composition to 1 part water has a rheology below 3,000 centipoise.

The polyglycol may be present in an amount from about 2.5 to about 15 wt. %, preferably, from about 4 to about 10 wt. %, by weight of the detergent composition, and more preferably, from about 6 to about 8 wt. %, by weight of the detergent composition. In some embodiments, the polyglycol is about 5 wt. %; in other embodiments, the polyglycol is about 7.5 wt. %, by weight of the detergent composition.

In an embodiment, the polyglycol has a molecular weight between 200 and 1200 Daltons, preferably, 300 to 800 Daltons, and most preferably from 300 to 500 Daltons. The polyglycol may be a linear polyglycol. The polyglycol may be a star, comb, and/or network polyglycol.

In some embodiments, the detergent composition is free of linear alkyl sulfates (LAS). The detergent composition may include a component selected from a group consisting of: a C2 to C5 polyol, a C2 to C5 alkanolamine, an active enzyme, a whitening agent, a bittering agent, a linear alkylbenzene sulfonate, a fatty alcohol ethoxylate, and a combination thereof, wherein the alkyl-ether sulfate, linear alkylbenzene sulfonate, and fatty alcohol ethoxylate are collectively present in an amount of 30 to 70 wt. %, by weight of the detergent composition.

BRIEF DESCRIPTION OF THE DRAWINGS

The accompanying drawings illustrate various examples of the principles described herein and are a part of the specification. The illustrated examples do not limit the scope of the claims.

DETAILED DESCRIPTION OF THE INVENTION

The following description provides specific details, such as materials and amounts, to provide a thorough understanding of the present invention. The skilled artisan, however, will appreciate that the present invention can be practiced without employing these specific details. Indeed, the present invention can be practiced in conjunction with processing, manufacturing or fabricating techniques conventionally used in the detergent composition industry.

Absent explicit statement to the contrary, wt. % in the specification refers to the weight percentage of an ingredient as compared to the total weight of the detergent composition. Accordingly, the calculation of wt. % for a detergent composition or an ingredient thereof does not include, for example, the weight of the film. For example, the wt. % of sodium lauryl ether sulfate (SLES) refers to the weight percentage of the active SLES in the composition. The wt. % of the total water in the liquid composition is calculated based on all the water including those added as a part of individual ingredients. When an ingredient added to make the liquid composition is not 100% pure and used as a mixture, e.g., in a form of a solution, the wt. % of that material added refers to the weight percentage of the mixture. Thus, a component which is 5 wt. % of the formulation, may be added as 5 wt. % of a pure component or 10 wt. % of solution that is 50% component and 50% water. Either result produces the recited 5 wt. % amount of the component in the resulting formulation. All percentages presented in this specification and the associated claims are weight percentages unless explicitly identified otherwise. Mole fractions and volume fractions are not used unless explicitly identified.

As used in this specification and the associated claims, organic molecules may be represented using the notation of the letter C followed by a number, e.g., C12. The number indicates the number of carbon atoms in the associated organic molecule. The identified organic molecules need not be hydrocarbons but may include substitutions, for example, C3 polyols would include both glycerin and propylene glycol, both of which have three carbons in their structure and multiple hydroxyl substitutions.

Figure 1:
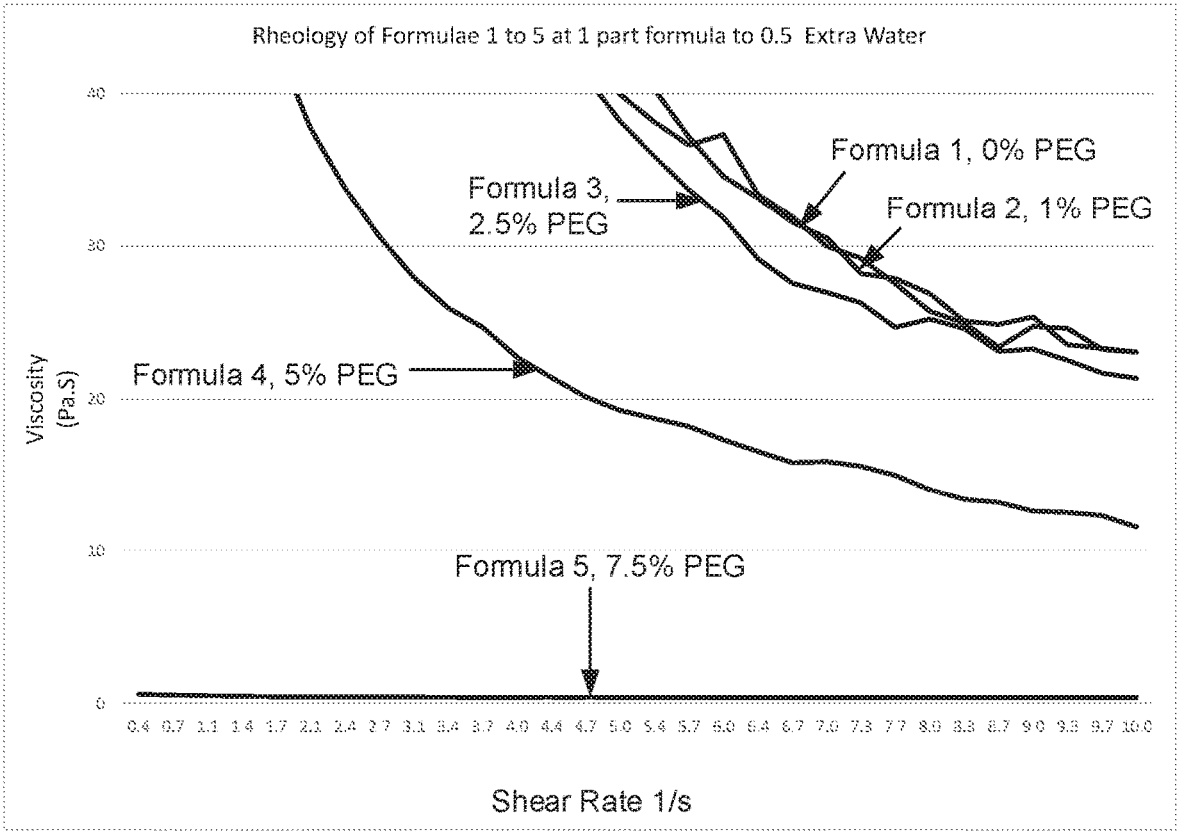
FIG. 1 shows the viscosity curves for a group of five formulae having increasing amounts of polyglycols in a detergent composition, the viscosity cures are for mixtures of 1 part detergent composition to 0.5 parts additional water, consistent with the present specification.

Rheology control agent: The present invention uses a rheology control agent, also referred as a rheology modifying agent, to adjust (e.g., reduce) viscosity during dilution of the unit-dose detergent composition. The mechanism is not fully understood; however, the effectiveness of this approach is demonstrated, for example, by the results shown in the figures. FIG. 1 shows a set of formulations containing different amounts of polyglycol rheology control agent as mixtures of 1 part detergent formulation to 0.5 parts additional water. The impact of the rheology control agent concentration on the viscosity is visible in the decreasing viscosity with increasing concentration of polyglycol. The high viscosity mixtures show non-Newtonian sheer thinning.

The rheology control agent is a water soluble material which reduces the free water in the unit-dose detergent composition. By reducing the free water, rheology control agents are normally associated with increasing the viscosity of solutions. However, it appears the rheology control agents' reduction in free energy of the water in the formulation facilitate dilution of the detergent composition with water. The rheology control agent provides a reduced free energy of the water in the formulation. This reduced free energy in turn, may reduce the tendency to phase separate and facilitate dilution. As a mental model, the rheology control agent can be thought of as stabilizing (by reducing the energy of) the water in the formulation during dilution. Thus, a wide variety of materials may function as rheology control agents based on their ability to reduce the free energy of the water in the detergent composition and their ability to continue to perform this stabilization as water is added to the formulation.

The detergent composition described exists as a liquid in the unit-dose packet. The detergent composition is formulated to be shelf stable, for example, not to undergo unexpected and/or determination changes during shipping, storage, etc. prior to use. In some embodiments, the detergent composition is substantially free of solids. The detergent composition may be substantially free of precipitates. The detergent composition may remain free of precipitates and/or other solids during storage and/or environmental testing conditions to simulate storage.

The detergent composition disperses into the wash liquid. The dilution from the detergent composition to the concentration in the wash liquid may be substantial, for example, over multiple orders of magnitude. A variety of factors encourage the use of smaller unit dose detergent composition packages, including storage size, cost of the film used to contain the unit dose, etc. Generally speaking, consumers may prefer smaller detergent composition dose formulations as convenient and storable. Because the goal is to deliver the same amount of detergent compositions and other active components, many unit dose detergent compositions include lower concentrations of solvents, such as water. Unit dose detergent compositions may also use other solvents and/or mixtures of solvents to increase the storage stability of the water soluble film in contact with the detergent composition.

Accordingly, the detergent composition is stable in its concentrated composition and at its dilute composition. Studies of different mixture ratios of detergent composition to water have found a 2:1 ratio provides relevant modeling of its dissolution-viscosity behavior, which may be measured by large increases in viscosity. It has been noticed that once the rheology control agent is added in sufficient quantity, the viscosity behavior ceases to have the observed non-Newtonian shear thinning. Thus, the rheology control agent changes the type of behavior (non-Newtonian to Newtonian) and prevents the multiple order of magnitude increase in viscosity observed without the rheology control agent. In the present formulations, the rheology control agent not only effectively prevents increases in viscosity of the formulation during dilution. It actually lowers viscosity of the formulation during dilution to make it easier for dissolution and use.

While not wishing to be bound by a particular theory, it appears that the basis of stability in the concentrated condition and the dilute (normal use) condition are different and that passing through the intermediate concentration places the formulation outside the regions of stability which define the behavior of the concentrated and dilute formulations. Adding a rheology control agent helps to maintain a consistent, low viscosity profile to enhance hydration and dissolution profile.

It has been unexpectedly discovered that polyglycol polymers may be used as rheology modifying agents. The ability to control the chain length and type of polyglycols used allows tuning of the properties of the resulting polymer.

Polyglycols are available in a wide variety of homopolymers and copolymers. As used in this specification and the associated claims, polyglycols refers to unmodified polyglycol polymers. That is to say, the polymer consists of a set of repeat units connected by ether links. The repeat units contain unsubstituted hydrocarbons. In an embodiment, the polyglycol is a polyethylene oxide (PEO) which is also known as polyethylene glycol (PEG). The polyglycol may be a polypropylene glycol (PPG). The polyglycol may be a mixture of either PEG or PPG with at least one other glycol unit. The copolymers may be block copolymers. The copolymers may be random copolymers. The copolymers may be other forms, such as alternating copolymers.

In an embodiment, the polyglycol has a molecular weight between 200 and 1200 Daltons, preferably, 300 to 800 Daltons, and most preferably from 300 to 500 Daltons. The polyglycol may be a linear polyglycol. The polyglycol may be a star, comb, and/or network polyglycol.

The polyglycol may be present in an amount from about 2.5 to about 15 wt. %, preferably, from about 4 to about 10 wt. %, by weight of the detergent composition, and more preferably, from about 6 to about 8 wt. %, by weight of the detergent composition. The effectiveness of these concentrations can be seen in the viscosity data shown in FIG. 1 especially, in Formula 4 (5 wt. %) and Formula 5 (7.5 wt. %).

In an embodiment, the polyglycol may be a polyethylene glycol homopolymer (PEG). The polyglycol may be a polypropylene glycol homopolymer (PPG). The polyglycol may be a copolymer which includes PEG and/or PPG repeat units along with other glycol repeat units. The repeat units may have pendant alkyl substitutions, for example, a methyl group.

Unit dose detergent compositions may include a variety of components including but not limited to: surfactants (anionic, cationic, non-ionic, zwitterionic and/or amphoteric), humectants, non-aqueous solvents, water, builders, complexers, chelators, enzymes, foam stabilizers, colorants, colorant stabilizers, optical brighteners, whitening agents, bittering agents, perfumes, and other optional components.

Surfactants: Useful surfactants in the liquid compositions of the present invention include, for example, an anionic surfactant, a nonionic surfactant, a cationic surfactant, an ampholytic surfactant, a zwitterionic surfactant, and/or mixtures thereof. The use of multiple surfactants of a particular type or a distribution of different weights of a surfactant may be particularly useful. The categories of surfactants will be discussed individually, below.

Anionic Surfactants: Suitable anionic surfactants include but not limited to those surfactants that contain a long chain hydrocarbon hydrophobic group in their molecular structure and a hydrophilic group, i.e., water solubilizing group including salts such as carboxylate, sulfonate, sulfate, or phosphate groups. Suitable anionic surfactant salts include sodium, potassium, calcium, magnesium, barium, iron, ammonium and amine salts. Other suitable secondary anionic surfactants include the alkali metal, ammonium and alkanol ammonium salts of organic sulfuric reaction products having in their molecular structure an alkyl, or alkaryl group containing from 8 to 22 carbon atoms and a sulfonic or sulfuric acid ester group.

In one embodiment, the anionic surfactant is a polyethoxylated alcohol sulfate, such as those sold under the trade name CALFOAM® 303 (Pilot Chemical Company, California). Such materials, also known as alkyl-ether sulfates (AES) or alkyl polyethoxylate sulfates, are those which correspond to the following formula (I):

$$R'—O—(C_2H_4O)_n—SO_3M' \quad (I)$$

wherein R' is a $C_8$-$C_{20}$ alkyl group, n is from 1 to 20, and M' is a salt-forming cation; preferably, R' is $C_{10}$-$C_{18}$ alkyl, n is from 1 to 15, and M' is sodium, potassium, ammonium, alkylammonium, or alkanolammonium. In an embodiment, R' is a $C_{12}$-$C_{16}$ alkyl, n is from 1 to 6 and M' is sodium. In one preferred embodiment, the alkyl-ether sulfate has a $C_{12}$ alkyl chain, for example, sodium lauryl ether sulphate (SLES).

The alkyl-ether sulfates will generally be used in the form of mixtures comprising varying R' chain lengths and varying degrees of ethoxylation. The heterogeneity of chain length may be due to the sourcing of the material and/or the processing of the material. Frequently such mixtures will inevitably also contain some unethoxylated alkyl sulfate materials, i.e., surfactants of the above ethoxylated alkyl sulfate formula wherein n=0. Unethoxylated alkyl sulfates may also be added separately to the liquid compositions of this invention. Suitable unalkoxylated, e.g., unethoxylated, alkyl-ether sulfate surfactants are those produced by the sulfation of higher $C_8$-$C_{20}$ fatty alcohols. Conventional primary alkyl sulfate surfactants have the general formula of: $ROSO_3M$, wherein R is typically a linear $C_8$-$C_{20}$ hydrocarbyl group, which may be straight chain or branched chain, and M is a water-solubilizing cation; preferably R is a $C_{10}$-$C_{15}$ alkyl, and M is alkali metal. In one embodiment, R is $C_{12}$-$C_{14}$ and M is sodium. Examples of other anionic surfactants are disclosed in U.S. Pat. No. 6,284,230, the disclosure of which is incorporated by reference herein.

The anionic surfactant may include a water-soluble salt of an alkyl benzene sulfonate having between 8 and 22 carbon atoms in the alkyl group. In one embodiment, the anionic surfactant comprises an alkali metal salt of $C_{10-16}$ alkyl benzene sulfonic acids, such as $C_{11-14}$ alkyl benzene sulfonic acids. In one embodiment, the alkyl group is linear and such linear alkyl benzene sulfonates are known in the art as "LAS." Other suitable anionic surfactants include sodium and potassium linear, straight chain alkylbenzene sulfonates in which the average number of carbon atoms in the alkyl group is between 11 and 14. Sodium $C_{11}$-$C_{14}$, e.g., $C_{12}$, LAS are exemplary of suitable anionic surfactants for use herein.

In one embodiment, the anionic surfactant includes at least one α-sulfofatty acid ester. Such a sulfofatty acid is typically formed by esterifying a carboxylic acid with an alkanol and then sulfonating the α-position of the resulting ester. The α-sulfofatty acid ester is typically of the following formula (II):

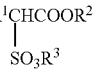

(II)

wherein $R^1$ is a linear or branched alkyl, $R^2$ is a linear or branched alkyl, and $R^3$ is hydrogen, a halogen, a monovalent or di-valent cation, or an unsubstituted or substituted ammonium cation. $R^1$ can be a $C_4$ to $C_{24}$ alkyl, including a $C_{10}$, $C_{12}$, $C_{14}$, $C_{16}$ and/or $C_{18}$ alkyl. $R^2$ can be a $C_1$ to $C_8$ alkyl, including a methyl group. $R^3$ is typically a monovalent or di-valent cation, such as a cation that forms a water soluble salt with the α-sulfofatty acid ester (e.g., an alkali metal salt such as sodium, potassium or lithium). The α-sulfofatty acid ester of formula (II) can be a methyl ester sulfonate, such as a $C_{16}$ methyl ester sulfonate, a $C_{18}$ methyl ester sulfonate, or a mixture thereof. In another embodiment, the α-sulfofatty acid ester of formula (II) can be a methyl ester sulfonate, such as a mixture of $C_{12}$-$C_{18}$ methyl ester sulfonates.

More typically, the α-sulfofatty acid ester is a salt, such as a salt according to the following formula (III):

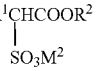

(III)

wherein $R^1$ and $R^2$ are linear or branched alkyls and $M^2$ is a monovalent metal. $R^1$ can be a $C_4$ to $C_{24}$ alkyl, including a $C_{10}$, $C_{12}$, $C_{14}$, $C_{16}$, and/or $C_{18}$ alkyl. $R^2$ can be a $C_1$ to $C_8$ alkyl, including a methyl group. $M^2$ is typically an alkali metal, such as sodium or potassium. The α-sulfofatty acid ester of formula (III) can be a sodium methyl ester sulfonate, such as a sodium $C_8$-$C_{18}$ methyl ester sulfonate.

In one embodiment, the detergent composition contains about 5 wt. % to about 30 wt. % of one or more anionic surfactants, preferably about 8 wt. % to about 20 wt. %, more preferably about 10 wt. % to about 15 wt. %. In some embodiments, the anionic surfactant is provided in a solvent.

Suitable nonionic surfactants include but not limited to alkoxylated fatty alcohols, ethylene oxide (EO)-propylene oxide (PO) block polymers, and amine oxide surfactants. Suitable for use in the liquid compositions herein are those nonionic surfactants which are normally liquid. Suitable nonionic surfactants for use herein include the alcohol alkoxylated nonionic surfactants. Alcohol alkoxylates are materials which correspond to the general formula of: $R^9(C_mH_{2m}O)_nOH$, wherein $R^9$ is a linear or branched $C_8$-$C_{16}$ alkyl group, m is from 2 to 4, and n ranges from 2 to 12; alternatively $R^9$ is a linear or branched $C_{9-15}$ or $C_{10-14}$ alkyl group. In another embodiment, the alkoxylated fatty alcohols will be ethoxylated materials that contain from 2 to 12, or 3 to 10, ethylene oxide (EO) moieties per molecule. The alkoxylated fatty alcohol materials useful in the liquid compositions herein will frequently have a hydrophilic-lipophilic balance (HLB) which ranges from 3 to 17, from 6 to 15, or from 8 to 15. Alkoxylated fatty alcohol nonionic surfactants have been marketed under the tradenames Neodol and Dobanol by the Shell Chemical Company. Another nonionic surfactant suitable for use includes ethylene oxide (EO)-propylene oxide (PO) block polymers, such as those marketed under the tradename Pluronic. These materials are formed by adding blocks of ethylene oxide moieties to the ends of polypropylene glycol chains to adjust the surface active properties of the resulting block polymers. In one embodiment, the nonionic surfactant is $C_{12}$-$C_{15}$ alcohol ethoxylate 7EO, that is to say having seven ethylene oxide moieties per molecule. The fatty alcohol ethoxylate may have 3 to 17 moles of ethylene oxide units per mole of fatty alcohol ethoxylate.

Another embodiment of a nonionic surfactant is alkoxylated, preferably ethoxylated or ethoxylated and propoxylated fatty acid alkyl esters, having from 1 to 4 carbon atoms in the alkyl chain, especially fatty acid methyl esters, as described, for example, in JP58/217598, which is incorporated by reference herein. In one embodiment, the nonionic surfactant is methyl ester ethoxylate.

Suitable nonionic surfactants also include polyalkoxylated alkanolamides, which are generally of the following formula (IV):

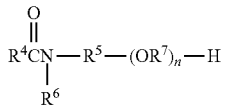

(IV)

wherein $R^4$ is an alkyl or alkoxy, $R^5$ and $R^7$ are alkyls and n is a positive integer. $R^4$ is typically an alkyl containing 6 to 22 carbon atoms. $R^5$ is typically an alkyl containing 1-8 carbon atoms. $R^7$ is typically an alkyl containing 1 to 4 carbon atoms, and more typically an ethyl group. The degree of polyalkoxylation (the molar ratio of the oxyalkyl groups per mole of alkanolamide) typically ranges from about 1 to about 100, or from about 3 to about 8, or about 5 to about 6. $R^6$ can be hydrogen, an alkyl, an alkoxy group or a polyalkoxylated alkyl. The polyalkoxylated alkanolamide is typically a polyalkoxylated mono- or di-alkanolamide, such as a $C_{16}$ and/or $C_{18}$ ethoxylated monoalkanolamide, or an ethoxylated monoalkanolamide prepared from palm kernel oil or coconut oil. The use of coconut oil, palm oil, and similar naturally occurring oils as precursors may be favored by consumers.

Other suitable nonionic surfactants include those containing an organic hydrophobic group and a hydrophilic group that is a reaction product of a solubilizing group (such as a carboxylate, hydroxyl, amido or amino group) with an alkylating agent, such as ethylene oxide, propylene oxide, or a polyhydration product thereof (such as polyethylene glycol). Such nonionic surfactants include, for example, polyoxyalkylene alkyl ethers, polyoxyalkylene alkylphenyl ethers, polyoxyalkylene sorbitan fatty acid esters, polyoxyalkylene sorbitol fatty acid esters, polyalkylene glycol fatty acid esters, alkyl polyalkylene glycol fatty acid esters, polyoxyethylene polyoxypropylene alkyl ethers, polyoxyalkylene castor oils, polyoxyalkylene alkylamines, glycerol fatty acid esters, alkylglucosamides, alkylglucosides, and alkylamine oxides. Other suitable surfactants include those disclosed in U.S. Pat. Nos. 5,945,394 and 6,046,149, the disclosures of which are incorporated herein by reference. In another embodiment, the composition is substantially free of nonylphenol nonionic surfactants. In this context, the term "substantially free" means less than about one weight percent.

Yet another nonionic surfactant useful herein comprises amine oxide surfactants. Amine oxides are often referred to in the art as "semi-polar" nonionics, and have the following formula (V):

$$R^{10}(EO)_x(PO)_y(BO)_zN(O)(CH_2R^{11})_2 \cdot qH_2O \quad (V)$$

wherein $R^{10}$ is a hydrocarbyl moiety which can be saturated or unsaturated, linear or branched, and can typically contain from 8 to 24, from 10 to 16 carbon atoms, or a C12-C16 primary alkyl. $R^{11}$ is a short-chain moiety such as a hydrogen, methyl and —$CH_2OH$. When x+y+z is greater than 0, EO is ethyleneoxy, PO is propyleneoxy and BO is butyleneoxy. In this formula, q is the number of water molecules in the surfactant. In one embodiment, the nonionic surfactant is $C_{2-14}$ alkyldimethyl amine oxide.

In one embodiment, the detergent composition includes about 15 wt. % to about 40 wt. % of one or more nonionic surfactants, preferably about 18 wt. % to about 30 wt. %, more preferably about 20 wt. % to about 25 wt. %.

Zwitterionic and/or Amphoteric Surfactants: Suitable zwitterionic and/or amphoteric surfactants include but not limited to derivatives of secondary and tertiary amines, derivatives of heterocyclic secondary and tertiary amines, or derivatives of quaternary ammonium, quaternary phosphonium or tertiary sulfonium compounds, such as those disclosed in U.S. Pat. No. 3,929,678, which is incorporated by reference herein.

Suitable zwitterionic and/or amphoteric surfactants for uses herein include amido propyl betaines and derivatives of aliphatic or heterocyclic secondary and ternary amines in which the aliphatic moiety can be straight chain or branched and wherein one of the aliphatic substituents contains from 8 to 24 carbon atoms and at least one aliphatic substituent contains an anionic water-solubilizing group. When present, zwitterionic and/or amphoteric surfactants typically constitute from 0.01 wt. % to 20 wt. %, preferably, from 0.5 wt. % to 10 wt. %, and most preferably 2 wt. % to 5 wt. % of the formulation by weight.

Cationic Surfactants: Suitable cationic surfactants include but not limited to quaternary ammonium surfactants. Suitable quaternary ammonium surfactants include mono $C_6$-$C_{16}$, or $C_6$-$C_{10}$ N-alkyl or alkenyl ammonium surfactants, wherein the remaining N positions are substituted by, e.g., methyl, hydroxyethyl or hydroxypropyl groups. Another cationic surfactant is $C_6$-$C_{18}$ alkyl or alkenyl ester of a quaternary ammonium alcohol, such as quaternary chlorine esters. In another embodiment, the cationic surfactants have the following formula (VI):

$$\left[ H_3C-\underset{R^{12}}{\overset{CH_3}{\overset{|}{\underset{|}{N^+}}}}-(CH_2CH_2O)_nH \right] X^- \quad (VI)$$

wherein $R^{12}$ is $C_8$-$C_{18}$ hydrocarbyl and mixtures thereof, or $C_{8-14}$ alkyl, or $C_8$, $C_{10}$, or $C_{12}$ alkyl, X is an anion such as chloride or bromide, and n is a positive integer.

In one embodiment, the surfactant of the liquid composition of the invention comprises an anionic surfactant, a nonionic surfactant, or mixtures thereof. In another embodiment, the anionic surfactant is alkyl benzene sulfonic acid, methyl ester sulfate, sodium lauryl ether sulfate, or mixtures thereof. In another embodiment, the nonionic surfactant is alcohol ethoxylate, methyl ester ethoxylate, or mixtures thereof.

The surfactants may be a mixture of at least one anionic and at least one nonionic surfactant. In another embodiment, the anionic surfactant is sodium lauryl ether sulfate. In another embodiment, the surfactant is a mixture of at least two anionic surfactants. In one embodiment, the surfactant comprises a mixture of an alkyl benzene sulfonate and an alkyl-ether sulfate. In another embodiment, and the alkyl-ether sulfate is sodium lauryl ether sulphate (SLES).

In certain embodiments, the surfactant comprises about 15 wt. % to about 30 wt. % of an anionic surfactant selected from the group consisting of alkyl benzene sulfonate, methyl ester sulfonate, sodium lauryl ether sulphate, and mixtures thereof, and about 15 wt. % to about 30 wt. % of an nonionic surfactant selected from the group consisting of alcohol ethoxylate, methyl ester ethoxylate, and mixtures thereof. Surfactants may collectively total more than 30 wt. % of the formulation. Surfactants are often the base of detergent compositions, however, other components, such as solvents and humectants may be used to make a liquid formulation rather than a solid formulation.

In an embodiment, the unit dose detergent composition includes an alkyl-ether sulfate, a linear alkylbenze sulfonate, and a fatty alcohol ethoxylate. These three materials may collectively make up no less than 30% of the formulation.

In an embodiment, an alkyl-ether sulfate makes up 5 wt. % to about 30 wt. %, preferably about 8 wt. % to about 20 wt. %, and more preferably about 10 wt. % to about 15 wt. % of the detergent composition. A fatty alcohol ethoxylate may makes up about 15 wt. % to about 40 wt., preferably about 18 wt. % to about 30 wt. %, and more preferably about 20 wt. % to about 25 wt. % of the detergent composition. A linear alkyl benzene sulfonate may make up about 1 wt. % to about 12 wt. %, preferably about 2 wt. % to about 8 wt. %, and most preferably, about 4 wt. % to about 6 wt. % of the detergent composition. In some preferred embodiments, the alkyl-ether sulfate, the linear alkyl benzene sulfonate, and the fatty alcohol ethoxylate may be present in a ratio of (2 to 5):1:(3 to 10); preferably in a ratio of (2.5 to 3.5):1:(4 to 6); and most preferably in a ratio of approximately 3:1:5.

Humectants: A humectant, for purposes of the present invention, is a substance that exhibits high affinity for water, especially attracting water for moisturization and solubilization purposes. The water is absorbed into the humectant; not merely adsorbed at a surface layer. The water absorbed by the humectant is available to the system; the water is not too tightly bound to the humectant. For example, in a skin lotion, the humectant attracts moisture from the surrounding atmosphere while reducing transepidermal water loss, and makes the water available to the skin barrier. Similarly, the humectant in a single dose liquid formula will not trap all the water needed for solubilization of other formula components—it will help to maintain the water balance between the formula, the film, and the atmosphere. Humectants possess hydrophilic groups which form hydrogen bonds with water. Common hydrophilic groups include hydroxyl, carboxyl, ester, and amine functionalities. A humectant can thus act as a solubilizer and moisture regulator in a unit dose formulation. Useful humectants include but not limited to polyols.

The polyol (or polyhydric alcohol) may be a linear or branched alcohol with two or more hydroxyl groups. Thus diols with two hydroxyl groups attached to separate carbon atoms in an aliphatic chain may also be used. The polyol typically includes less than 9 carbon atoms, such as 9, 8, 7, 6, 5, 4, 3, or 2 carbon atoms. Preferably, the polyol includes 3 to 8 carbon atoms. More preferably, the polyol includes 3 to 6 carbon atoms. The molecular weight is typically less than 500 g/mol, such as less than 400 g/mol or less than 300 g/mol.

Embodiments of suitable polyols include, but not limited to: propylene glycol, butylene glycol, pentylene glycol, hexylene glycol, heptylene glycol, octylene glycol, 2-methyl-1,3-propanediol, xylitol, sorbitol, mannitol, diethylene glycol, triethylene glycol, glycerol, erythritol, dulcitol, inositol, and adonitol.

The unit dose detergent compositions of the present invention may contain about 5 wt. % to about 75 wt. % of one or more humectants, preferably about 7 wt. % to about 50 w.t %, more preferably about 10 wt. % to about 40 wt. %. In one preferred embodiment, the liquid composition comprises 20 to 30 wt. % of one or more $C_2$ to $C_5$ polyols. Preferably, the $C_2$ to $C_5$ polyols comprise a mixture of glycerine and propylene glycol, where the ratio of glycerine to propylene glycol is from 2:1 to 1:2. The liquid composition may be substantially free of monoalcohols, for example, the composition may comprise less than 1 wt. % of monoalcohols.

The unit dose detergent compositions of the present invention may optionally comprise other ingredients that can typically be present in detergent products and/or personal care products to provide further benefits in terms of cleaning power, solubilization, appearance, fragrance, etc. Different groups of such materials are described below.

Water: Water functions as a solvent and viscosity modifier. Water may be present as no more than 30 wt. % of the unit dose detergent composition. Water may comprise no more than 25 wt. % of the unit dose detergent composition. Water may comprise no more than 20 wt. % of the unit dose detergent composition.

Builders. Other suitable components include organic or inorganic detergency builders. Examples of water-soluble inorganic builders that can be used, either alone or in combination with themselves or with organic alkaline sequestrant builder salts, are glycine, alkyl and alkenyl succinates, alkali metal carbonates, alkali metal bicarbonates, phosphates, polyphosphates and silicates. Specific examples of such salts are sodium tripolyphosphate, sodium carbonate, potassium carbonate, sodium bicarbonate, potassium bicarbonate, sodium pyrophosphate and potassium pyrophosphate. Examples of organic builder salts that can be used alone, or in combination with each other, or with the preceding inorganic alkaline builder salts, are alkali metal polycarboxylates, water-soluble citrates such as sodium and potassium citrate, sodium and potassium tartrate, sodium and potassium ethylenediaminetetracetate (EDTA), sodium and potassium N(2-hydroxyethyl)-nitrilo triacetates, sodium and potassium N-(2-hydroxyethyl)-nitrilo diacetates, sodium and potassium oxydisuccinates, and sodium and potassium tartrate mono- and di-succinates, such as those described in U.S. Pat. No. 4,663,071, the disclosure of which is incorporated herein by reference.

Complexer/Chelator. Complexer and chelators help washing liquids support higher amounts of soils and/or metal ions. Complexer and/or chelators may functionally overlap with builders as discussed above. These are often poly carboxylic acids and/or salts thereof. Polyamines also may be used in this role. Suitable examples include iminodisuccinic acid, succinic acid, citric acid, ethylenediaminetetraacetic acid, etc. A complexer and/or chelator may make up about 0 to about 5 wt. % of the formulation, preferably about 0.1 to about 3 wt. % of the formulation, and most preferably about 0.5 to about 2 wt. % of the detergent composition.

Enzymes. Suitable enzymes include those known in the art, such as amylolytic, proteolytic, cellulolytic or lipolytic type, and those listed in U.S. Pat. No. 5,958,864, the disclosure of which is incorporated herein by reference. One protease, sold under the trade name SAVINASE® by Novozymes A/S, is a subtillase from *Bacillus lentus*. Other suitable enzymes include proteases, amylases, lipases and cellulases, such as ALCALASE® (bacterial protease), EVERLASE® (protein-engineered variant of SAVINASE®), ESPERASE® (bacterial protease), LIPOLASE® (fungal lipase), LIPOLASE ULTRA (Protein-engineered variant of LIPOLASE), LIPOPRIME® (protein-engineered variant of LIPOLASE), TERMAMYL® (bacterial amylase), BAN (Bacterial Amylase Novo), CELLUZYME® (fungal enzyme), and CAREZYME® (monocomponent cellulase). Additional enzymes of these classes suitable for use in accordance with the present invention will be well-known to those of ordinary skill in the art, and are available from a variety of commercial suppliers. Enzymes maybe provided with other components, including stabilizers. In an embodiment, the enzyme material may be approximately 10% by weight of active enzymes. The detergent composition may include about 0.01 to about 1.3 wt. %, preferably, 0.05 to 0.50 wt. %, and most preferably, about 0.08 to about 0.3 wt. % of active enzymes.

Foam Stabilizers. Foam stabilizing agents include, but not limited to, a polyalkoxylated alkanolamide, amide, amine oxide, betaine, sultaine, $C_8$-$C_{18}$ fatty alcohols, and those disclosed in U.S. Pat. No. 5,616,781, the disclosure of which is incorporated by reference herein. Foam stabilizing agents are used, for example, in amounts of about 1 wt. % to about 20 wt. %, and typically about 3. wt. % to about 5 wt. %. The composition can further include an auxiliary foam stabilizing surfactant, such as a fatty acid amide surfactant. Suitable fatty acid amides are $C_8$-$C_{20}$ alkanol amides, monoethanolamides, diethanolamides, and isopropanolamides.

Colorants. In some embodiments, the liquid composition does not contain a colorant. In some embodiments, the liquid composition contains one or more colorants. The colorant(s) can be, for example, polymers. The colorant(s) can be, for example, dyes. The colorant(s) can be, for example, water-soluble polymeric colorants. The colorant(s) can be, for example, water-soluble dyes. The colorant(s) can be, for example, colorants that are well-known in the art or commercially available from dye or chemical manufacturers.

The color of the colorant(s) is not limited, and can be, for example, red, orange, yellow, blue, indigo, violet, or any combination thereof. The colorant(s) can be, for example, one or more Milliken LIQUITINT colorants. The colorant(s) can be, for example Milliken LIQUITINT: VIOLET LS, ROYAL MC, BLUE HP, BLUE MC, AQUAMARINE, GREEN HMC, BRIGHT YELLOW, YELLOW LP, YELLOW BL, BRILLIANT ORANGE, CRIMSON, RED MX, PINK AL, RED BL, RED ST, or any combination thereof.

The colorant(s) can be, for example, one or more of Acid Blue 80, Acid Red 52, and Acid Violet 48. When the colorant(s) are selected from the group consisting of Acid Blue 80, Acid Red 52, and Acid Violet 48, the liquid composition, optionally, does not contain a colorant stabilizer. Surprisingly, it has been found that Acid Blue 80, Acid Red 52, and Acid Violet 48, do not display significant discoloration over time, and thus, can be used without (e.g., in the absence of) a colorant stabilizer.

The colorant may provide a secondary indicator of source for a user. The colorant may provide aesthetic or informational value. For example, the color of the detergent composition may be used to indicate a preferred water temperature (e.g., red for hot, blue for cold).

The total amount of the one or more colorant(s) that can be contained in the liquid composition, for example, can range from about 0.00001 wt. % to about 0.099 wt. %. The total amount of colorant(s) in the liquid composition can be, for example, about 0.0001 wt. %, about 0.001 wt. %, about 0.01 wt. %, about 0.05 wt. %, or about 0.08 wt. %.

Colorant Stabilizer(s). In some embodiments, the liquid composition can optionally contain a colorant stabilizer. In some embodiments, the colorant stabilizer can be citric acid. The total amount of the optionally present colorant stabilizer(s) in the liquid composition can range, for example, from about 0.01 wt. % to about 5.0 wt. %. The total amount of the colorant stabilizer(s) in the liquid composition can be, for example, about 0.1 wt. %, about 1 wt. %, about 2 wt. %, about 3 wt. %, or about 4 wt. %.

Optical Brightener/Whitening Agents. Optical brighteners and/or whitening agents help washed material appear white, especially under florescent light. The particular whitening agent is not believed to be impactful to the shelf stability of the formulations. Whitening agents may be complex, polycyclic molecules. Examples of whitening agents include: 4,4'-diamino-2,2'-stilbenedisulfonic acid and 2,5-bis(benzoxazol-2-yl)thiophene. The substitution of similar whitening agents and/or reasonable modifications of their concentration in the formulation should produce similar results. An optical brightener and/or whitening agent may make up about 0 to about 5 wt. % of the formulation, preferably about 0.1 to about 3 wt. % of the formulation, and most preferably about 0.5 to about 2 wt. % of the detergent composition.

Bittering Agent. Bittering agents may optionally be added to hinder accidental ingestion of the composition. Bittering agents are compositions that taste bad, so children and/or others are discouraged from accidental ingestion. Exemplary bittering agents include denatonium benzoate, aloin, and others. Denatonium is available under a variety of trade names including: BITTERANT-b, BITTER+PLUS, Bitrex, and/or Aversion. Bittering agents may be present in the composition at an amount of from about 0 to about 1 wt. %, preferably from about 0 to about 0.5 wt. %, and most preferably from about 0 to about 0.1 wt. %, based on the total weight of the detergent composition.

Perfumes. The liquid compositions of the invention may optionally include one or more perfumes or fragrances. As used herein, the term "perfume" is used in its ordinary sense to refer to and include any fragrant substance or mixture of substances including natural (obtained by extraction of flowers, herbs, leaves, roots, barks, wood, blossoms or plants), artificial (mixture of natural oils or oil constituents) and synthetically produced odoriferous substances. Typically, perfumes are complex mixtures of blends of various organic compounds such as alcohols, aldehydes, ethers, aromatic compounds and varying amounts of essential oils (e.g., terpenes) such as from 0 wt. % to 80 wt. %, usually from 1 wt. % to 70 wt. %, the essential oils themselves being volatile odoriferous compounds and also serving to dissolve the other components of the perfume. Suitable perfume ingredients include those disclosed in "Perfume and Flavour Chemicals (Aroma Chemicals)", published by Steffen Arctander (1969), which is incorporated herein by reference. Perfumes can be present from about 0.1 wt. % to about 10 wt. %, and preferably from about 0.5 wt. % to about 5 wt. % of the detergent composition.

Other Optional Ingredients. The liquid compositions may also contain one or more optional ingredients conventionally included in detergent compositions such as a pH buffering agent, a perfume carrier, a fluorescer, a hydrotrope, an antifoaming agent, an antiredeposition agent, a polyelectrolyte, an optical brightening agent, a pearlescer, an anti-shrinking agent, an anti-wrinkle agent, an anti-spotting agent, an anti-corrosion agent, a drape imparting agent, an anti-static agent, an ironing aids crystal growth inhibitor, an anti-oxidant, an anti-reducing agent, a chelating agent, a dispersing agent, a defoamer, a color component, a fragrance component, a bleaching catalyst, a bleaching agent, a bleach activator, a whitening agent, a brightening agent, an anti-corrosion agent, a deodorizing agent, a color/texture rejuvenating agent, a soil releasing polymer, a preservative, a bittering agent, and a mixture thereof. Examples and sources of suitable such components are well-known in the art and/or are described herein. For example, a preferred bittering agent is denatonium benzoate, sold under the tradename Bitrex® (Johnson Matthey).

Water-Soluble Pouch. The unit dose detergent compositions of the present invention may be placed a water-soluble pouch. The water soluble pouch is made from a water-soluble material which dissolves, ruptures, disperses, or disintegrates upon contact with water, releasing thereby the liquid composition. In one embodiment, the water soluble pouch is made from a lower molecular weight water-soluble polyvinyl alcohol film-forming resin.

The water soluble pouch may be formed from a water soluble polymer selected from the group consisting of polyvinyl alcohol (PVA), polyvinyl pyrrolidone, polyalkylene oxide, polyacrylamide, poly acrylic acid, cellulose, cellulose ether, cellulose ester, cellulose amide, polyvinyl acetate, polycarboxylic acid and salt, polyaminoacid, polyamide, polyanhydride copolymer of maleic/acrylic acid, polysaccharide, natural gums, polyacrylate, water-soluble acrylate copolymer, methylcellulose, carboxymethylcellulose sodium, dextrin, ethylcellulose, hydroxyethyl cellulose, maltodextrin, polymethacrylate, polyvinyl alcohol copolymer, hydroxypropyl methyl cellulose (HPMC), and mixtures thereof.

Unit dose pouches and methods of manufacture thereof that are suitable for use with the compositions of the present invention include those described, for example, in U.S. Pat. Nos. 3,218,776; 4,776,455; 4,973,416; 6,479,448; 6,727,215; 6,878,679; 7,259,134; 7,282,472; 7,304,025; 7,329,441; 7,439,215; 7,464,519; 7,595,290; 8,551,929; the disclosures of all of which are incorporated herein by reference in their entireties. In some embodiments, the pouch is a water-soluble, single-chamber pouch, prepared from a water-soluble film. According to one such aspect of the invention, the single-chamber pouch is a formed, sealed pouch produced from a water-soluble polymer or film such as polyvinylalcohol (PVA) or a PVA film.

Preferred water soluble polymers for forming the pouch are polyvinyl alcohol (PVA) resins sold under tradename MONOSOL® (MonoSol LLC, Indiana). The preferred grade is MONOSOL® film having a weight average molecular weight range of about 55,000 to 65,000 and a number average molecular weight range of about 27,000 to 33,000. Preferably, the film material will have a thickness of approximately 3 mil or 75 micrometers. Alternatively, commercial grade PVA films are suitable for use in the present invention, such as those that are commercially available from Monosol (Merrillville, Ind.) (e.g., Monosol film M8310) or from Aicello (Aiichi, Japan; North American subsidiary in North Vancouver, BC, Canada) (e.g., Aicello GA or Aicello GS).

In various embodiments, the film is desirably strong, flexible, shock resistant, and non-tacky during storage at both high and low temperatures and high and low humidities. In one embodiment, the film is initially formed from polyvinyl acetate, and at least a portion of the acetate functional groups are hydrolyzed to produce alcohol groups. The film may include polyvinyl alcohol (PVOH), and may include a higher concentration of PVOH than polyvinyl acetate. Such films are commercially available with various levels of hydrolysis, and thus various concentrations of PVOH, and in an exemplary embodiment the film initially has about 85 percent of the acetate groups hydrolyzed to alcohol groups. Some of the acetate groups may further hydrolyze in use, so the final concentration of alcohol groups may be higher than the concentration at the time of packaging. The film may have a thickness of from about 25 to about 200 micrometers (μm), or from about 45 to about 100 μm, or from about 75 to about 90 μm in various embodiments.

In some embodiments, the water soluble pouch further comprises a cross-linking agent. In some embodiments, the cross-linking agent is selected from the group consisting of formaldehyde, polyesters, epoxides, isocyanates, vinyl esters, urethanes, polyimides, acrylics with hydroxyl, carboxylic, isocyanate or activated ester groups, bis(methacryloxypropyl)tetramethylsiloxane (styrenes, methylmethacrylates), n-diazopyruvates, phenylboronic acids, cis-platin, divinylbenzene (styrenes, double bonds), polyamides, dialdehydes, triallyl cyanurates, N-(2-ethanesulfonylethyl) pyridinium halides, tetraalkyltitanates, titanates, borates, zirconates, or mixtures thereof. In one embodiment, the cross-linking agent is boric acid or a boric acid salt such as sodium borate.

In additional embodiments, the water-soluble pouch or film from which it is made can contain one or more additional components, agents or features, such as one or more perfumes or fragrances, one or more enzymes, one or more surfactants, one or more rinse agents, one or more dyes, one or more functional or aesthetic particles, and the like. Such components, agents or features can be incorporate into or on the film when it is manufactured, or are conveniently introduced onto the film during the process of manufacturing the liquid composition of the present invention, using methods that are known in the film-producing arts.

The water-soluble container (e.g., pouch) used in association with the present invention may be in any desirable shape and size and may be prepared in any suitable way, such as via molding, casting, extruding or blowing, and is then filled using an automated filling process. Examples of processes for producing and filling water-soluble pouches, suitable for use in accordance with the present invention, are described in U.S. Pat. Nos. 3,218,776; 3,453,779; 4,776,455; 5,699,653; 5,722,217; 6,037,319; 6,727,215; 6,878,679; 7,259,134; 7,282,472; 7,304,025; 7,329,441; 7,439,215; 7,464,519; and 7,595,290; the disclosures of all of which are incorporated herein by reference in their entireties. In preferred embodiments, the pouches are filled with the liquid composition of the present invention using the cavity filling approach described in U.S. Pat. Nos. 3,218,776 and 4,776,455. The machinery necessary for carrying out this process is commercially available, e.g., from Cloud Packaging Solutions (Des Plaines, Ill.; a division of Hearthside Food Solutions LLC).

Example Formulations: Five formulae with variable amounts (0 to 7.5 wt. %) of a polyglycol rheology control (rheology modifying agent) agent are documented below. The viscosities of mixtures of 1 part detergent composition to 0.5 parts additional water were measured according to the method described below. The viscosity measurements are charted in FIG. 1.

TABLE 1

| Component | Formula 1 wt. % | Formula 2 wt. % | Formula 3 wt. % | Formula 4 wt. % | Formula 5 wt. % |
|---|---|---|---|---|---|
| PEG-400 | 0 | 1 | 2.5 | 5 | 7.5 |
| Glycerine | 14.87 | 13.87 | 12.37 | 9.87 | 7.37 |
| Propylene Glycol | 8.21 | 8.21 | 8.21 | 8.21 | 8.21 |
| AES (60% active) | 26 | 26 | 26 | 26 | 26 |
| $C_{12}$-$C_{15}$ Alcohol Ethoxylate 7EO | 23.07 | 23.07 | 23.07 | 23.07 | 23.07 |
| Coconut Oil Fatty Acid | 10 | 10 | 10 | 10 | 10 |
| Water | 5.7 | 5.7 | 5.7 | 5.7 | 5.7 |
| 2-Phenyl Sulfonic Acid (LAS) | 5.0 | 5.0 | 5.0 | 5.0 | 5 |
| Alkanolamine | 3.15 | 3.15 | 3.15 | 3.15 | 3.15 |
| Enzymes (10% active) | 1.85 | 1.85 | 1.85 | 1.85 | 1.85 |
| Fragrance | 1.0 | 1.0 | 1.0 | 1.0 | 1.0 |
| Builder (33% active) | 0.9 | 0.9 | 0.9 | 0.9 | 0.9 |
| Optical Brightener | 0.2 | 0.2 | 0.2 | 0.2 | 0.2 |
| Bittering Agent | 0.05 | 0.05 | 0.05 | 0.05 | 0.05 |

Test Method: Unit dose detergent composition formulation is added to additional water (not originally in the formulation) at 2:1 ratio. Viscosity increases have been observed. The viscosities of the mixtures and undiluted formulas were measured with a AR2000-EX Rheometer, the shear rate increased from 0.41 to 10 l/s over 5 minutes at 20° C. with a geometry cone of 40 mm, 1:59:49 (degree:min:sec), and a truncation gap of 52 microns. The data from the viscosity testing is available in the table below. The viscosity is in Pascal*seconds on the vertical axis, where 1 Pa*s is equivalent to 1000 cps, and the horizontal axis shows increasing shear rates in revolutions per second.

FIG. 1 shows viscosity measurements of formulae 1 to 5 according the method described above. The formulations contained a variable amount of glycerine to compensate for the variation in rheology control agent. Providing over 2.5 wt. % of the polyglycol in the formula appears to measurably reduce viscosity during dilution of the formulation, with response becoming significant somewhere between 2.5 and 5 wt. % and reaching completeness somewhere between 5 and 7.5 wt. %. While adding additional polyglycol beyond 7.5 wt. % may provide other benefits, the additional impact on the viscosity of the formula during hydration may be limited.

The response to the polyglycol appears to be non-linear and small doses (e.g., 1 wt. %) may not produce a practical improvement. Once a threshold amount of the polyglycol is reached (between 2.5 and 5 wt. %), small additional increases in polyglycol reduce the viscosity during dilution. At a concentration between 5 wt. % and 7.5 wt. % PEG-400, the viscosity curve becomes relatively flat with respect to shear rate, indicating more Newtonian behavior.

The unit dose detergent compositions, formulas 1-5, without any additional water generally produced viscosities of approximately 200 to 250 cps. With the addition of water, the viscosity of some of the formulas climbed drastically but eventually drops back down.

In FIG. 1, the mixtures of 1 part detergent composition with 0.5 parts of additional water are shown. The viscosity of each of Formulae 1 to 3 is greatest at low shear rates and decreases as the shear rate increases. This shear thinning behavior is non-Newtonian. In contrast, Formula 5 (7.5 wt. % PEG), upon 2:1 dilutions of detergent composition: additional water, perform more like Newtonian fluids. Formula 4 (5 wt. % PEG) performs in between Newtonian and non-Newtonian fluids.

A Newtonian fluid is a fluid, where the ratio between shear stress changes linearly in proportion to the stress it is exposed to. This proportion is known as viscosity. As shown in the viscosity curves of Formulae 1-5, increasing the amount of the polyglycol rheology controlling agent in the unit dose compositions not only shows a trend of changing the behavior of the fluids (from non-Newtonian to Newtonian) but also lowering the viscosity of the detergent composition, upon dilution with water. Both are advantageous for dissolution of the unit dose detergent production which is exposed to water during use.

The following table contains the viscosity data measured by using the above described test method.

The following table contains the data shown in FIG. 1.

TABLE 2

| | Rheology of Mixtures of 1 Part Formula to 0.5 Parts Additional Water | | | | |
|---|---|---|---|---|---|
| Shear Rate (1/s) | 0% PEG Formula 1 | 1% PEG Formula 2 | 2.5% PEG Formula 3 | 5% PEG Formula 4 | 7.5% PEG Formula 5 |
| | Viscosity (Pa · S) | | | | |
| 0.41 | 808 | 712.7 | 634.2 | 157.1 | 0.636 |
| 0.75 | 388.4 | 345.5 | 326.5 | 93.31 | 0.585 |
| 1.08 | 245.1 | 217.2 | 210 | 66.09 | 0.529 |
| 1.41 | 178.8 | 157.2 | 156.3 | 51.94 | 0.503 |
| 1.73 | 141.2 | 121.7 | 125.4 | 43.35 | 0.473 |
| 2.06 | 115.7 | 100.8 | 105.8 | 37.8 | 0.461 |
| 2.39 | 97.3 | 88.16 | 92.32 | 33.85 | 0.459 |
| 2.72 | 86.07 | 77.46 | 80.78 | 30.63 | 0.461 |
| 3.06 | 71.28 | 69.14 | 71.57 | 27.95 | 0.455 |
| 3.39 | 62.99 | 62.35 | 64.00 | 25.94 | 0.441 |
| 3.71 | 54.93 | 56.75 | 56.50 | 24.68 | 0.430 |
| 4.05 | 52.65 | 51.8 | 50.26 | 22.71 | 0.427 |
| 4.37 | 50.07 | 46.25 | 45.04 | 21.39 | 0.434 |
| 4.71 | 46.19 | 44.1 | 41.21 | 20.15 | 0.431 |
| 5.03 | 39.97 | 41.76 | 38.21 | 19.24 | 0.421 |
| 5.37 | 38.16 | 40.32 | 35.9 | 18.72 | 0.421 |
| 5.70 | 36.65 | 37.17 | 33.71 | 18.20 | 0.427 |
| 6.03 | 37.34 | 34.6 | 31.87 | 17.33 | 0.419 |
| 6.36 | 33.41 | 33.17 | 29.16 | 16.55 | 0.417 |
| 6.68 | 31.94 | 31.56 | 27.57 | 15.82 | 0.421 |
| 7.02 | 29.98 | 30.53 | 26.96 | 15.88 | 0.415 |
| 7.35 | 29.19 | 28.2 | 26.28 | 15.57 | 0.418 |
| 7.68 | 27.54 | 27.87 | 24.68 | 14.99 | 0.416 |
| 8.01 | 25.74 | 26.89 | 25.22 | 14.04 | 0.413 |
| 8.34 | 24.97 | 25.10 | 24.61 | 13.39 | 0.417 |
| 8.67 | 23.39 | 24.87 | 23.10 | 13.19 | 0.411 |
| 8.99 | 24.75 | 25.36 | 23.27 | 12.61 | 0.416 |
| 9.32 | 24.62 | 23.56 | 22.53 | 12.53 | 0.409 |
| 9.66 | 23.24 | 23.3 | 21.69 | 12.32 | 0.414 |
| 9.99 | 23.06 | 23.08 | 21.36 | 11.58 | 0.410 |

Without wishing to be bound by theory, it is believed that it is the alkyl-ether sulfates (AES) such as sodium lauryl ether sulfate (SLES) in a unit dose composition that mainly contributes to the initial increase of viscosity during dilution. As shown in the below study, Formula 6 consists of a mixture of SLES and water in a 7 to 3 ratio by weight. The data for the rheology curve for this mixture is in Table 3, below.

Figure 2:
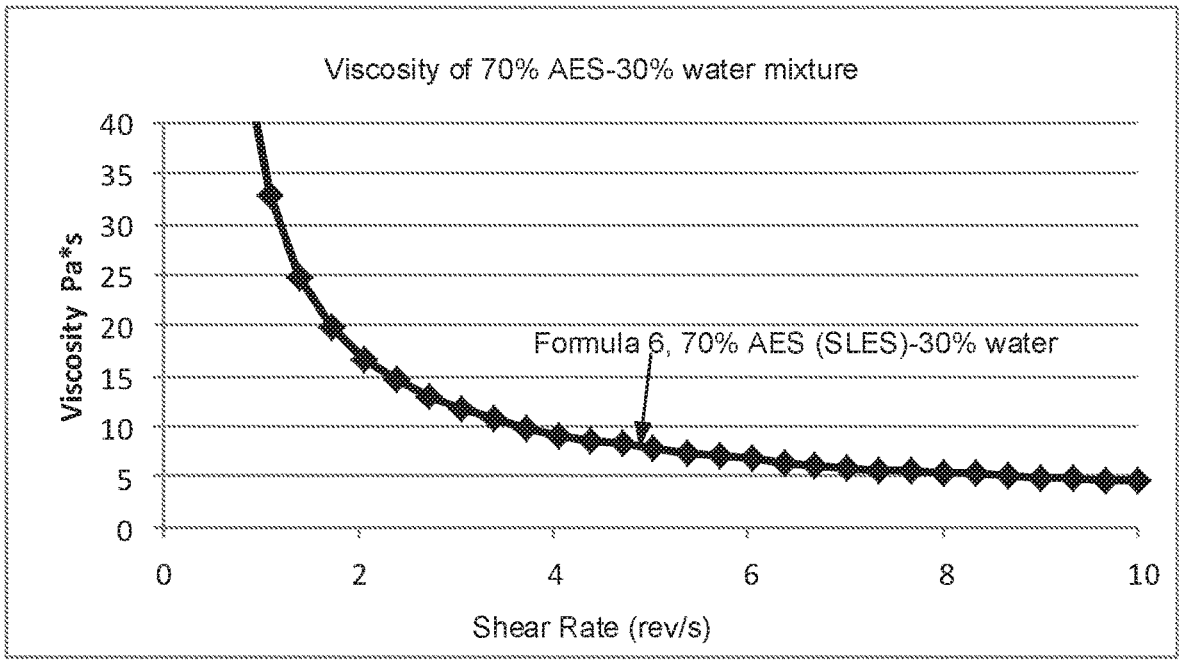
FIG. 2 shows a viscosity curve for a 70:30 mixture of an alkyl-ether sulfate: water.

The following table contains the data shown in FIG. 2. This is a 7 parts SLES: 3 parts water mixture. This figure has the same vertical axis as FIG. 1 to allow for ready comparison.

TABLE 3

| | Mixture of 7 parts AES (SLES) to 3 parts water Formula 6 |
|---|---|
| Shear Rate (1/s) | Viscosity (Pa · S) |
| 0.41 | 95.51 |
| 0.75 | 49.48 |
| 1.08 | 32.98 |
| 1.41 | 24.73 |
| 1.73 | 19.84 |
| 2.06 | 16.66 |
| 2.39 | 14.55 |
| 2.72 | 12.92 |
| 3.06 | 11.77 |
| 3.39 | 10.64 |
| 3.71 | 9.708 |
| 4.05 | 9.031 |
| 4.37 | 8.616 |
| 4.71 | 8.195 |
| 5.03 | 7.684 |
| 5.37 | 7.263 |

TABLE 3-continued

| Shear Rate (1/s) | Mixture of 7 parts AES (SLES) to 3 parts water Formula 6 Viscosity (Pa · S) |
|---|---|
| 5.70 | 6.970 |
| 6.03 | 6.687 |
| 6.36 | 6.276 |
| 6.68 | 6.086 |
| 7.02 | 5.888 |
| 7.35 | 5.652 |
| 7.68 | 5.586 |
| 8.01 | 5.383 |
| 8.34 | 5.295 |
| 8.67 | 5.093 |
| 8.99 | 4.923 |
| 9.32 | 4.756 |
| 9.66 | 4.613 |
| 9.99 | 4.483 |

The viscosity data of Table 3 has been graphed as FIG. 2. FIG. 2 shows the high viscosities and non-Newtonian sheer thinning. Accordingly, this data supports the idea that the SLES contributes to and/or is responsible for the viscosity increase observed during initial dilution in the absence of a rheology modifier.

Accordingly, the present application provides a method for providing a unit dose detergent composition that maintains a consistent, low viscosity profile for enhanced hydration and dissolution. The method includes the steps of: providing the detergent composition including: a polyglycol as a rheology modifying agent; alkyl-ether sulfates, wherein the alkyl-ether sulfates comprise from about 12 to about 50 wt. %, by weight of the detergent composition; and water, wherein a mixture of 2 parts of the detergent composition to 1 part water has a rheology below 3,000 centipoise as measured using an AR2000-EX Rheometer at 20° C. with a geometry cone of 40 mm, 1:59:49 (degree:min:sec), and a truncation gap of 52 microns.

Preferably, the alkyl-ether sulfate (AES) contains a sodium cation. Preferably, the alkyl-ether sulfate comprises a C12 alkyl chain. Most preferably, the alkyl-ether sulfate is sodium laureth ether sulfate (SLES). In some embodiments, the detergent composition does not include LAS.

The polyglycol may be present in an amount from about 2.5 to about 15 wt. %, preferably, from about 4 to about 10 wt. %, by weight of the detergent composition, and more preferably, from about 6 to about 8 wt. %, by weight of the detergent composition. In some embodiments, the polyglycol is about 5 wt. %; in other embodiments, the polyglycol is about 7.5 wt. %, by weight of the detergent composition.

The present application also provides a unit dose detergent product, including: unit dose package comprising a water soluble film, the unit dose packaging enclosing the detergent composition, wherein the detergent composition comprises: a polyglycol; alkyl-ether sulfates, wherein the alkyl-ether sulfates comprise from about 12 to about 50 wt. %, by weight of the detergent composition; and water, wherein a mixture of 2 parts of the detergent composition to 1 part water has a rheology below 3,000 centipoise as measured using an AR2000-EX Rheometer at 20° C. with a geometry cone of 40 mm, 1:59:49 (degree:min:sec), and a truncation gap of 52 microns.

In some embodiments, the unit dose detergent product does not include LAS. The unit dose detergent product may further include: a C2 to C5 polyol, a C2 to C5 alkanolamine, an active enzyme, a whitening agent, a bittering agent, a linear alkylbenzene sulfonate, and a fatty alcohol ethoxylate, wherein the alkyl-ether sulfate, linear alkylbenzene sulfonate, and fatty alcohol ethoxylate are collectively present in an amount of 30 to 70 wt. %, by weight of the detergent composition.

It will be appreciated that, within the principles described by this specification, a vast number of variations exist. It should also be appreciated that the embodiments described are only embodiments, and are not intended to limit the scope, applicability, or construction of the claims in any way.

What is claimed is:

1. A method for maintaining a consistent, low viscosity profile of a unit dose detergent composition for enhanced hydration and dissolution upon hydration comprising:

providing the detergent composition comprising:

about 2.5 to about 15 wt. % of polyethylene glycol homopolymer having a molecular weight of 400 Daltons, sodium lauryl ether sulfate present in an amount of from about 10 to about 20 wt %, a linear alkylbenzene sulfonate comprising 2-dodecylbenzenesulfonic acid present in an amount of from about 5 to about 15 wt %, a $C_{12}$-$C_{15}$ alcohol ethoxylated with seven moles of ethylene oxide present in an amount of from about 15 to about 25 wt %, about 15.58 to about 30 wt. % of a combination of glycerine and propylene glycol and 2 to 8 wt % of a C2 to C5 alkanolamine, and water; and encapsulating the detergent composition in a pouch made of a water soluble film.

2. The method of claim 1, wherein the polyethylene glycol homopolymer is present in an amount from about 4 to about 10 wt. %, by weight of the detergent composition.

3. The method of claim 1, wherein the polyethylene glycol homopolymer is present in an amount from about 6 to about 8 wt. %, by weight of the detergent composition.

4. The method of claim 1, wherein a ratio of glycerine to propylene glycol in the unit dose detergent compositions is within 2:1 to 1:2.

5. A detergent composition comprising:

about 2.5 to about 15 wt. % of polyethylene glycol homopolymer having a molecular weight of 400 Daltons, sodium lauryl ether sulfate present in an amount of from about 10 to about 20 wt %, a linear alkylbenzene sulfonate comprising 2-dodecylbenzenesulfonic acid present in an amount of from about 5 to about 15 wt %, a $C_{12}$-$C_{15}$ alcohol ethoxylated with seven moles of ethylene oxide present in an amount of from about 15 to about 25 wt %, about 15.58 to about 30 wt. % of a combination of glycerine and propylene glycol and 2 to 8 wt % of a C2 to C5 alkanolamine, and water.

6. The detergent composition of claim 5, wherein the polyethylene glycol homopolymer is in an amount from about 4 to about 10 wt. %, by weight of the detergent composition.

7. The detergent composition of claim 5, wherein the polyethylene glycol homopolymer is in an amount from about 6 to about 8 wt. %, by weight of the detergent composition.

8. The detergent composition of claim 5, wherein the composition comprises less than 20 wt. % water.

9. A unit dose detergent product, comprising:

a unit dose pouch comprising a water soluble film, a detergent composition encapsulated in the unit dose pouch, wherein the detergent composition comprises:

about 2.5 to about 15 wt. % of polyethylene glycol homopolymer having a molecular weight of 400 Daltons, sodium lauryl ether sulfate present in an amount of from about 10 to about 20 wt %, a linear alkylbenzene sulfonate comprising 2-dodecylbenzenesulfonic acid present in an amount of from about 5 to about 15 wt %, a $C_{12}$-$C_{15}$ alcohol ethoxylated with seven moles of ethylene oxide present in an amount of from about 15 to about 25 wt %, about 15.58 to about 30 wt. % of a combination of glycerine and propylene glycol and 2 to 8 wt % of a C2 to C5 alkanolamine, and water, wherein a mixture of 2 parts of the detergent composition to 1 part water has a rheology below 3,000 centipoise.

10. The product of claim 9, wherein the polyethylene glycol homopolymer-is in an amount from about 4 to about 10 wt. %, by weight of the detergent composition.

11. The product of claim 9, wherein the polyethylene glycol homopolymer is in an amount from about 6 to about 8 wt. %, by weight of the detergent composition.

12. The product of claim 9, wherein the detergent composition further comprises a component selected from a group consisting of:

an active enzyme, a whitening agent, a bittering agent, and a combination thereof.

13. The method of claim 1 wherein:

the polyethylene glycol homopolymer having a molecular weight of 400 Daltons is present in an amount of from about 2.5 to about 7.5 wt %, the glycerine is present in an amount of from about 7.4 to about 12.4 wt %, the propylene glycol is present in an amount of about 8.2 wt %, the sodium lauryl ether sulfate is present in an amount of about 15.6 wt %, the $C_{12}$-$C_{15}$ alcohol ethoxylated with seven moles of ethylene oxide is present in an amount of about 23 wt %, the 2-dodecylbenzenesulfonic acid is present in an amount of about 5 wt %, and the alkanolamine is present in an amount of about 3.2 wt %.

14. The method of claim 13 wherein the composition further comprises:

about 10 wt % coconut oil fatty acid, about 0.185 wt % enzymes, about 1 wt % fragrance, about 0.3 wt % builder, about 0.2 wt % optical brightener, and about 0.05 wt % bittering agent.

15. The method of claim 1 wherein the composition consists of:

polyethylene glycol homopolymer having a molecular weight of 400 Daltons present in an amount of from about 2.5 to about 7.5 wt %, glycerine present in an amount of from about 7.4 to about 12.4 wt %, propylene glycol present in an amount of about 8.2 wt %, sodium lauryl ether sulfate present in an amount of about 15.6 wt %, $C_{12}$-$C_{15}$ alcohol ethoxylated with seven moles of ethylene oxide present in an amount of about 23 wt %, 2-dodecylbenzenesulfonic acid present in an amount of about 5 wt %, alkanolamine present in an amount of about 3.2 wt %, water, about 10 wt % coconut oil fatty acid, about 0.185 wt % enzymes, about 1 wt % fragrance, about 0.3 wt % builder, about 0.2 wt % optical brightener, and about 0.05 wt % bittering agent.

* * * * *